US007531277B1

(12) United States Patent
Facci

(10) Patent No.: US 7,531,277 B1
(45) Date of Patent: May 12, 2009

(54) SELF ERASING PHOTORECEPTOR CONTAINING AN ELECTROLUMINESCENT NANOMATERIAL

(75) Inventor: John S. Facci, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 293 days.

(21) Appl. No.: 11/534,321

(22) Filed: Sep. 22, 2006

(51) Int. Cl.
*G03G 5/10* (2006.01)

(52) U.S. Cl. ..... 430/62; 430/125.2; 399/343

(58) Field of Classification Search ..... 430/62, 430/125.2; 399/343
See application file for complete search history.

(56) References Cited

U.S. PATENT DOCUMENTS

2007/0237547 A1* 10/2007 Zona et al. ..... 399/168

* cited by examiner

*Primary Examiner*—John L Goodrow
(74) *Attorney, Agent, or Firm*—MH2 Technology Law Group LLP

(57) ABSTRACT

In accordance with the invention, there are electrophotographic photoreceptors, image forming apparatus and methods of forming an image. The electrophotographic photoreceptor can comprise a conductive layer comprising a plurality of electroluminescent nanomaterials, a first contact electrically connected to a first edge of the conductive layer and an electrical ground, a second contact electrically connected to a second edge of the conductive layer and a D.C. power supply, and a photosensitive layer disposed over the conductive layer, wherein the photosensitive layer comprises a charge generation material and a charge transport material. The D.C. power supply can be configured to supply a lateral voltage bias at the second contact to generate a localized electroluminescence across the conductive layer and deliver an erase illumination from within the electrophotographic photoreceptor.

19 Claims, 3 Drawing Sheets

FIG. 4
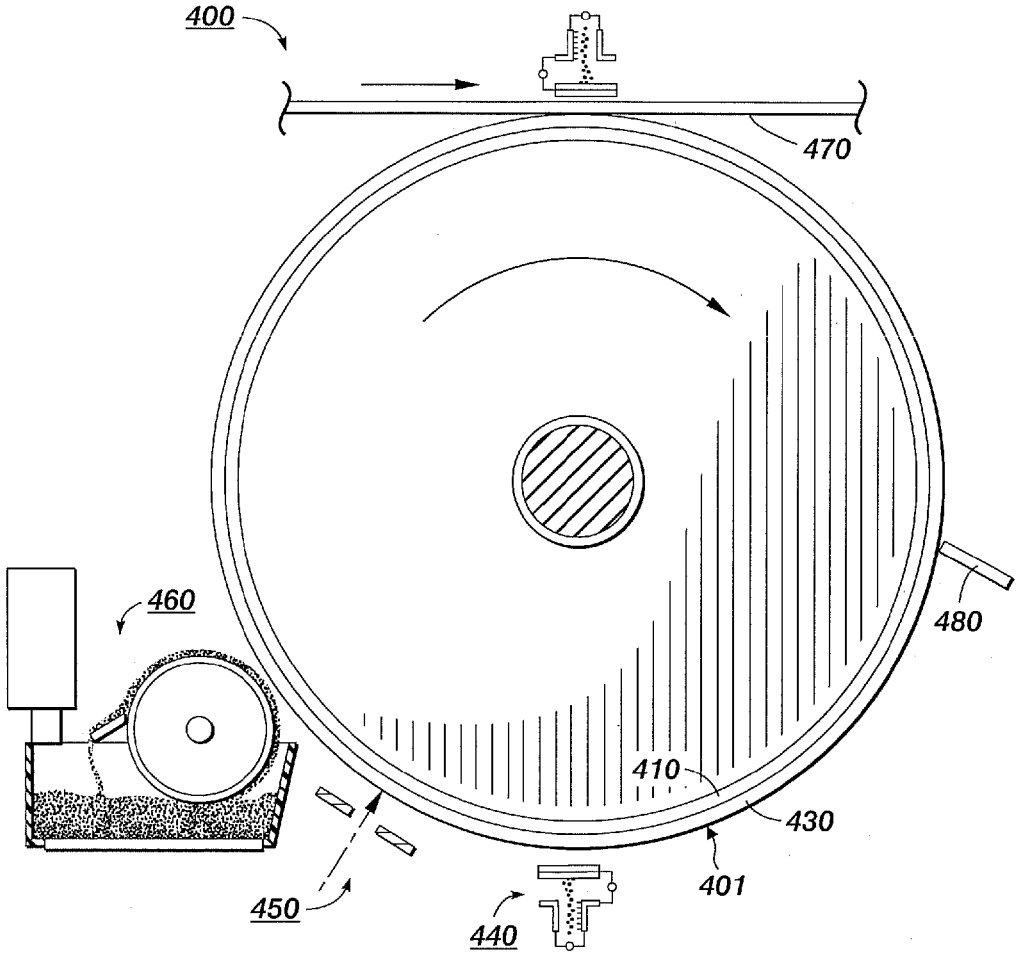
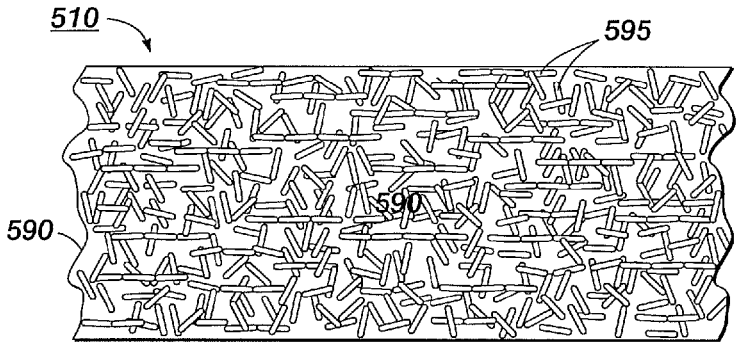
FIG. 5

SELF ERASING PHOTORECEPTOR CONTAINING AN ELECTROLUMINESCENT NANOMATERIAL

FIELD OF THE INVENTION

The subject matter of this invention relates to photoreceptors. More particularly, the subject matter of this invention relates to self erasing photoreceptors containing an optically transparent, conductive electroluminescent carbon nanotube ground plane for use in an electrophotographic apparatus.

BACKGROUND OF THE INVENTION

Trends in color xerographic printing include reduced box weight and size, higher process speeds and parallel printing in order to minimize cost, improve productivity and reliability. This has led to a drive for smaller photoreceptors, particularly drum photoreceptors which results in squeezing the space available to the subsystem components disposed around the photoreceptor. In electrophotographic systems, after the transfer of the toner to the paper, the toner is cleaned off the photoreceptor and the photoreceptor is exposed to an erase light to remove the residual latent image. However, long print runs of a single image can lead to variations in optical transparency related to image content. Further conductive ground planes based on strongly reducing metals such as Al, Ti, Zr are gradually converted to their oxides as a result of xerographic cycling. Also, holes traversing the photoreceptor in combination with ambient water electrochemically convert the metals to their insulating oxides resulting in a change in charge acceptance and transparency. Consequently both the erase illumination and ground plane conductivity vary spatially according to image content leading to image ghosts which limits photoreceptor life. Suitable materials for non-electrochemically reactive, optically transparent conductive ground planes are limited. Dispersed carbon particles are not electrochemically reactive but they are unsuitable material for conductive ground plane because of poor optical transparency. Other alternative optically transparent conductive ground planes such as cuprous oxide and conducting polymers including polypyrrole and polyaniline have problems due to relative immaturity of the technology.

Furthermore, it is difficult to achieve both high optical transparency and low ground plane resistivity (i.e. sheet resistivity) at the same time in either carbon filled or conductive ground planes based on metals such as Al, Ti, Zr. Moreover, belt photoreceptors that erase by illuminating through the ground plane, i.e. by "rear erase" require further increase in erase lamp intensity. In addition, the use of an anti-curl back coat on a belt photoreceptor further increases the need for higher intensity erase illumination because over time its surface becomes rather scratched and abraded. Consequently some of the illumination is scattered or diffracted and is prevented from reaching the charge generator layer.

Thus, there is a need to overcome these and other problems of the prior art to provide a method and system for internal erase illumination or "self erasing" of the photoreceptor comprising electroluminescent conductive ground plane.

SUMMARY OF THE INVENTION

In accordance with the invention, there is an electrophotographic photoreceptor. The electrophotographic photoreceptor can include a conductive layer including a plurality of electroluminescent nanomaterials. The electrophotographic photoreceptor can also include a first contact electrically connected to a first edge of the conductive layer and an electrical ground and a second contact electrically connected to a second edge of the conductive layer and a D.C. power supply. Furthermore, the electrophotographic photoreceptor can have the D.C. power supply configured to supply a lateral voltage bias at the second contact to generate a localized electroluminescence across the conductive layer and deliver an erase illumination from within the electrophotographic photoreceptor. The electrophotographic photoreceptor can also include a photosensitive layer disposed over the conductive layer, wherein the photosensitive layer includes a charge generation material and a charge transport material. Moreover, the electrophotographic photoreceptor can have the D.C. power supply configured to supply a lateral voltage bias at the second contact to generate a localized electroluminescence across the conductive layer and deliver an erase illumination from within the electrophotographic photoreceptor.

According to another embodiment of the present teachings, there is an image forming apparatus. The image forming apparatus can include an electrophotographic photoreceptor, wherein the electrophotographic photoreceptor includes a conductive layer, and wherein the conductive layer includes a plurality of electroluminescent nanomaterials. The image forming apparatus can also include a charging station for uniformly charging the electrophotographic photoreceptor and an imaging station for forming a latent image on the electrophotographic photoreceptor. The image forming apparatus can further include a development subsystem for converting the latent image to a visible image on the electrophotographic photoreceptor and a transfer station for transferring and fixing the visible image onto a media. The image forming apparatus can have the conductive layer with a first edge and a second edge opposite the first edge, wherein the first edge has a first contact connected to an electrical ground and the second edge has a second contact connected to a D.C. power supply. Moreover, the image forming apparatus can have the D.C. power supply configured to supply a lateral voltage bias at the second contact to generate a localized electroluminescence across the conductive layer and deliver an erase illumination from within the electrophotographic photoreceptor.

According to yet another embodiment of the present teachings, there is a method of forming an image. The method can include providing an electrophotographic photoreceptor, wherein the electrophotographic photoreceptor includes a conductive layer, and wherein the conductive layer includes a plurality of electroluminescent nanomaterials. The method can also include providing an imaging station for forming a latent image on the electrophotographic photoreceptor and providing a development subsystem for converting the latent image to a visible image on the electrophotographic photoreceptor. The method can further include providing a transfer station for transferring and fixing the visible image onto a media and applying a bias voltage laterally across the conductive layer to make the conductive layer glow laterally and deliver erase illumination from within the electrophotographic photoreceptor.

Additional advantages of the embodiments will be set forth in part in the description which follows, and in part will be obvious from the description, or may be learned by practice of the invention. The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

BRIEF DESCRIPTION OF THE DRAWINGS

FIG. 4 illustrates an exemplary image forming apparatus according to various embodiments of the present teachings.

FIG. 5 is a schematic illustration of an exemplary conductive layer comprising a plurality of carbon nanotubes according to various embodiments of the present teachings.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

The term "electrophotographic photoreceptor" is used interchangeably herein with "image receptor" and "photoreceptor". The term "conductive layer" is used interchangeably herein with "ground plane", "conductive ground plane", "electroluminescent conductive layer", "optically transparent conductive ground plane", etc. The term "nanomaterial" is used herein to refer to any material having at least one dimension in the nanoscale range of about 0.1 nm to about 100 nm, including but not limited to, for example, nanotubes, nanofibers, nanotorus, etc. Hence, nanomaterials, such as carbon nanotubes, need to have only a diameter in the nanoscale range, but a length of the carbon nanotube can be several millimeters, and similarly carbon nanotube sheets need to have only thickness in the nanoscale region, the width and length of the carbon nanotube sheet can be in the nanoscale, microscopic, or macroscopic range.

Self erasing photoreceptor including a conductive ground plane including a plurality of electroluminescent nanomaterials can provide several advantages. In some embodiments, the internal erase illumination can provide optical advantage of minimal required erase illumination because of proximity to the charge generating layer. In other embodiments, the fewer internal reflections can also minimize the required erase electroluminescent illumination. Additionally, internally generated illumination can not be diffracted by the scratched rear surface of a belt photoreceptor which occurs over time.

Figure 1:
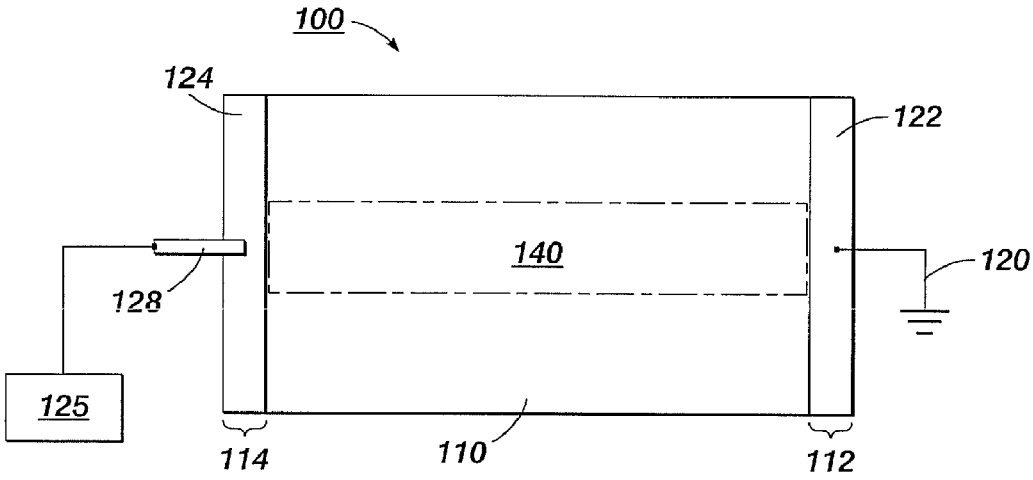
FIG. 1 is a schematic illustration of an exemplary electrophotographic photoreceptor according to various embodiments of the present teachings.
Figure 2:
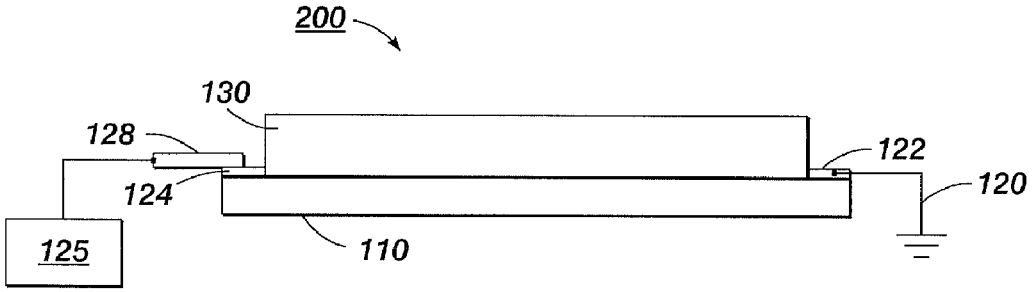
FIG. 2 illustrates side view of an exemplary electrophotographic photoreceptor in accordance with the present teachings.

FIG. 1 is a schematic illustration of an exemplary electrophotographic photoreceptor 100 according to various embodiments. The electrophotographic photoreceptor 100 can include a conductive layer 110 including a plurality of electroluminescent nanomaterials. The electrophotographic photoreceptor 100 can include a first contact 122 electrically connected to a first edge 112 of the conductive layer 110 and an electrical ground 120 and a second contact 124 electrically connected to a second edge 114 of the conductive layer 110 and a D.C. power supply 125. The electrophotographic photoreceptor 100 can also include a biasing contact 128 proximate to the second contact 124, connected to a D.C. power supply 125 to apply a voltage bias laterally across the conductive layer 110. The electrophotographic photoreceptor 100 can also include a photosensitive layer 130 disposed over the conductive layer 110 as shown in FIG. 2. The photosensitive layer 130 can include a charge generation material and a charge transport material. In some embodiments, the electrophotographic photoreceptor 100 can also include a protective hard coat layer over the photosensitive layer 130. The hard coat layer can have thickness from about 1 to about 5 microns and typically from about 2 to about 4 microns.

According to various embodiments, the plurality of electroluminescent nanomaterials can include a plurality of carbon nanotubes. In some embodiments, the conductive layer 110 can include carbon nanotube composite, including but not limited to carbon nanotube polymer composite, epoxy based carbon nanotube composite, and carbon nanotube filled resin. FIG. 5 is a schematic illustration of an exemplary conductive layer 510 including a plurality of carbon nanotubes 595 in a carbon nanotube composite 590. The conductive layer 110 can have a thickness from about 0.01 μm to about 1.5 μm and in some cases from about 0.05 μm to about 1 μm. The concentration of carbon nanotube in the carbon nanotube composite can be from about 0.01 wt % to about 10 wt % and in some cases from about 0.05 wt % to about 5 wt %. According to various embodiments, the carbon nanotubes can be SWNT (single walled carbon nanotubes) or MWNT (multi walled carbon nanotubes). Carbon nanotubes can have diameter from about 1 nm to about 100 nm and in some cases from about 5 nm to about 50 nm and can have length from about 50 nm to about 5 mm and in some cases from about 100 nm to about 1 mm. In other embodiments, the conductive layer 110 can include a layer of at least one carbon nanotube sheet on a substrate. The carbon nanotube sheet can have thickness in the range of about 50 nm to about 500 nm. In some embodiments, the conductive layer 110 can include carbon nanotube sheet supported by one or more optically transparent supporting layers. Non limiting examples of optically transparent supporting layers include polyethylene, oriented Mylar sheet, polycarbonate and other synthetic polymeric materials applied as an anti-curl layer to the electrophotographic photoreceptor 100.

The conductive layer 110 including carbon nanotubes can have several advantages over conventional metal films used for conductive ground planes. Carbon nanotubes exhibit many desirable properties for conductive ground plane such as high optical transparency with electronic conductivity, are non-oxidizable, flexible, and have high tensile strength. Carbon nanotubes can also exhibit electroluminescence in the visible and into the infrared spectrum, the wavelength range used for erasing in a photoreceptor. Baughman et. al. in *Science,* 2005, Vol. 309, No. 5738, pp. 1215-1219 disclosed a new method of producing transparent carbon nanotube sheets at a rate more than about seven meters per minute, which is incorporated by reference herein in its entirety. These unoptimized carbon nanotube sheets can exceed steel and carbon fiber material such as Kevlar in gravimetric strength. For example, micron thick carbon nanotube sheets can support liquid droplets 50,000 times their own weight. Also, carbon nanotube sheet can act as electrodes that can be reversibly deformed without losing electrical conductivity. Further, as electrodes, the carbon nanotube sheets can exhibit very little change in conductivity over a very wide temperature range.

Referring back to FIG. 1, the electrophotographic photoreceptor 100 can have the D.C. power supply 125 configured to supply a lateral voltage bias at the second contact 124 to generate a localized electroluminescence 140 across the conductive layer 110 and deliver an erase illumination from within the electrophotographic photoreceptor 100. The localized electroluminescence 140 across the conductive layer 110 can be from about 0.5 mm to about 10 cm and in some cases from about 1 mm to about 5 cm in width. The lateral voltage bias at the second contact 124 to generate electroluminescence 140 can be from about 20 V to about 80 V and in some cases from about 30 V to about 60 V. In accordance with various embodiments, the lateral bias can be applied using a biasing contact 128, where the biasing contact 128 can be for example a roller, a brush, a sliding contact such as a metal or carbon clip, etc. In some embodiments, the second contact 124 can be a strip of semiconductive material. The second contact 124 can have a sheet resistance of about $10^4$ to about $10^6$ ohm/sq. Suitable contact 124 can be any type of carbon particle filled resin or polymer where the concentration of carbon is adjusted to provide the desired resistivity. Non limiting examples of the first contact 122 include stainless steel roller, metal or carbon particle filled rollers, gold coated base metal (such as aluminum, copper, brass and the like), and a metal (such as aluminum, copper, brass) or carbon filled resin brush.

Referring back to FIG. 2, the photosensitive layer 130 can include a charge generation material and a charge transport material. The photosensitive layer 130 can have thickness from about 5 μm to about 50 μm and in some cases from about 15 μm to about 35 μm. In some embodiments, the photosensitive layer 130 can include a charge transport layer disposed over a charge generation layer. In other embodiments, the photosensitive layer 130 can include a charge generation layer disposed over a charge transport layer. Yet in some other embodiments, the charge generation material and the charge transport material can be dispersed in a common matrix such as polymer or resin. Non limiting examples of polymer or resin include polycarbonate, polystyrene, polyvinyl carbazole, and the like. The charge generating materials can include organic pigments and organic dyes such as for example hydroxygallium phthalocyanine, vanadyl phthalocyanine, titanyl phthalocyanine, metal-free-pthalocyanines, perylenes such as benzimidazole perylene and congeners, squaraine dyes, pigments, and the like, and mixtures thereof. The charge transporting materials can include organic arylamine compounds such as for example, triarylamines including its alkyl, aryl, alkoxy, aryloxy, halogen, amino substituted congeners, arylamine substituted biphenyl and terphenyl, and the like and the mixtures thereof.

Figure 3:
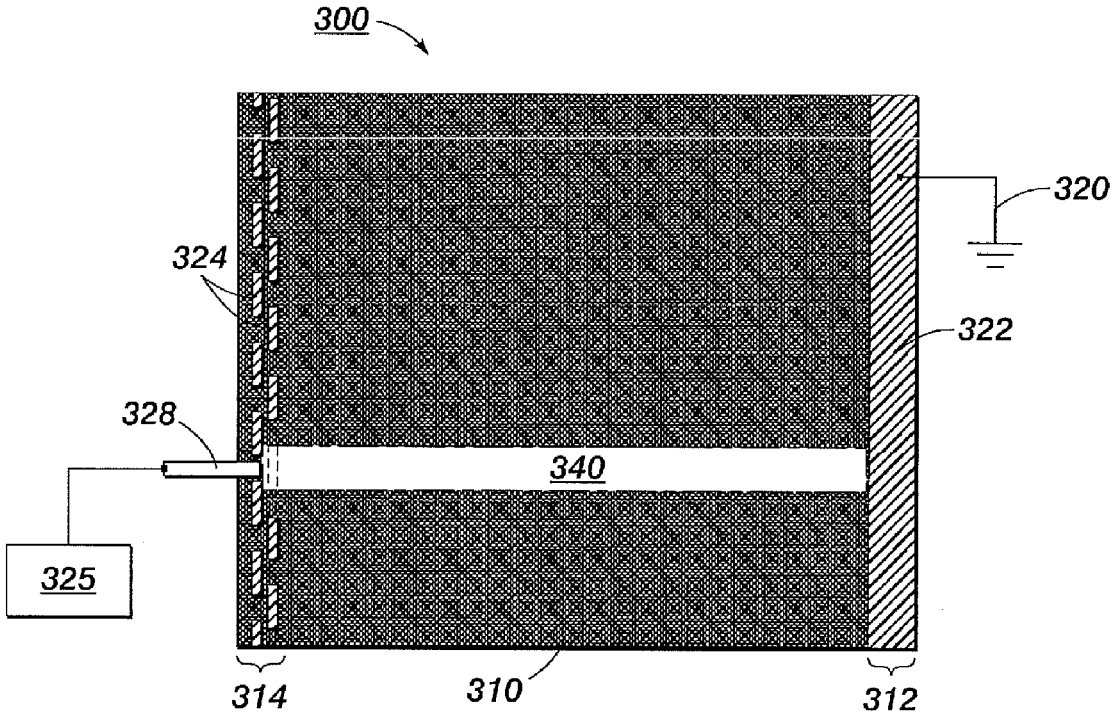
FIG. 3 is a schematic illustration of another exemplary electrophotographic photoreceptor in accordance with the present teachings.

FIG. 3 is a schematic illustration of another exemplary embodiment of an electrophotographic photoreceptor 300. The electrophotographic photoreceptor 300 can include a conductive layer 310 including a plurality of electroluminescent nanomaterial. The electrophotographic photoreceptor 300 can include a first contact 322 electrically connected to a first edge 312 of the conductive layer 310 and an electrical ground 320 and a second contact 324 electrically connected to a second edge 314 of the conductive layer 310 and a D.C. power supply 325. In some embodiments, the electrophotographic photoreceptor 300 can also include a biasing contact 328 proximate to the second contact 324 and connected to the D.C. power supply 325 to apply voltage bias laterally across the conductive layer 310 to generate a localized electroluminescence 340 across the conductive layer 310 and deliver an erase illumination from within the electrophotographic photoreceptor 300. The localized electroluminescence 340 across the conductive layer 310 can be from about 0.5 mm to about 10 cm and in some cases from about 1 mm to about 5 cm in width. The lateral voltage bias at the second contact 324 to generate electroluminescence 340 can be from about 20 V to about 80 V and in some cases from about 30 V to about 60 V. In certain embodiments, the second contact 324 can include a plurality of segmented staggered contact arrays 324. The segmented staggered contact arrays 324 can include at least two columns, a first column spatially separated from a second column, wherein each column includes segmented contacts spatially separated from each other. The first and the second column can be placed vertically offset to each other such that the segments of first column are vertically offset to the segments of the second column. The segmentation in the segmented staggered contact array 324 can prevent the entire conductive layer 310 from being energized by the voltage bias. Further, the staggering in the segmented staggered contact array 324 due to the vertical offset can ensure that all areas of the conductive layer 110 will emit light and produce erase illumination and hence complete erasure of the residual latent image. According to various embodiments, the first contact 322 and the second contact 324 can be made of the same conductive materials. In some embodiments, the first contact 322 and the second contact 324 can be at least one of stainless steel rollers, metal or carbon particle filled rollers, gold coated base metal (such as aluminum, copper, brass and the like), and a metal (such as aluminum, copper, brass) or carbon filled resin brush contact. The electrophotographic receptor 300 can also include a photosensitive layer 130 disposed over the conductive layer 110 as shown in FIG. 2. In various embodiments, the electrophotographic receptor 300 can also include a protective hard coat layer over the photosensitive layer 130.

According to various embodiments, the electrophotographic receptor 100, 300 can be a belt photoreceptor or a drum photoreceptor. However, current drum photoreceptors are based on a conductive drum substrate. Hence, the conductive substrate of the drum photoreceptor can be anodized in order not to short out the lateral voltage bias applied to the conductive layer 110. Alternatively, a plastic substrate can be used in the drum photoreceptor, and electrophotographic photoreceptor 100, 300 can be disposed over the plastic substrate. Further, to save space in drum photoreceptor, the location of the light emission can be coincident with the cleaning sub-system.

FIG. 4 illustrates an exemplary image forming apparatus 400. The exemplary image forming apparatus can include an electrophotographic photoreceptor 401. The electrophotographic receptor 401 can include a conductive layer 410 and a photosensitive layer 430 disposed over the conductive layer 410. The conductive layer 410 can include a plurality of electroluminescent nanomaterials. The image forming apparatus 400 can have a charging station 440 for uniformly charging the electrophotographic photoreceptor 401. The elcetrophotographic photoreceptor 401 can be a drum photoreceptor as shown in FIG. 4 or a belt photoreceptor (not shown). The image forming apparatus 400 can also include an imaging station 450 where an original document (not shown) can be exposed to a light source (also not shown) for forming a latent image on the electrophotographic photoreceptor 401. The image forming apparatus 400 can further include a development subsystem 460 for converting the latent image to a visible image on the electrophotographic photoreceptor 401 and a transfer station 470 for transferring and fixing the visible image onto a paper or other media. In some embodiments, the conductive layer 410 can have a first edge 112 and a second edge 114 opposite the first edge 112, wherein the first edge 112 has a first contact 122 connected to an electrical ground 120 and the second edge 114 has a second contact 124 connected to a D.C. power supply 125 as shown in FIG. 1. In various embodiments, the D.C. power supply 125 can be configured to supply the voltage bias at the second contact 124 to generate a localized electroluminescence 140 across the conductive layer 410 and deliver an erase illumination from within the electrophotographic photoreceptor 401. In some embodiments, the erase illumination can be from about 0.5 mm to about 10 cm and in some cases from about 1 mm to about 5 mm. According to various embodiments, the second contact 124 can be a strip of semiconductive material as shown in FIG. 1, with a sheet resistance of about $10^4$ to about $10^6$ ohm/sq. In some embodiments, the second contact 124 can include a segmented array of contacts 324 as shown in FIG. 3 that can prevent the entire conductive layer from being energized by the bias voltage. Yet in some other embodiments, the second contact can include a segmented staggered array of contacts 324, wherein the staggering of contacts can ensure that all areas of the conductive layer will emit light and deliver erase illumination as shown in FIG. 3, and wherein the second contact can be made of the same conductive material as the first contact.

In accordance with the invention, there is a method of forming an image. The method can include providing an electrophotographic photoreceptor 401, wherein the electrophotographic photoreceptor 401 can include a conductive layer 410 including a plurality of electroluminescent nanomaterials and a photosensitive layer 430 disposed over the conductive layer 410. The method can also include providing a charging station 440 for uniformly charging the electrophotographic photoreceptor 401. The method can further include providing an imaging station 450 where an original document (not shown) can be exposed to a light source (also not shown) for forming a latent image on the electrophotographic photoreceptor 401. The method can also include providing a development subsystem 460 for converting the latent image to a visible image on the electrophotographic photoreceptor 401 and a transfer station 470 for transferring and fixing the visible image onto a paper or other media. Furthermore, the method can include applying a bias voltage laterally across the conductive layer 410 to make the conductive layer 410 glow laterally and thereby deliver erase illumination. The erase illumination across the conductive layer 410 can be from about 0.5 mm to about 10 cm and in some cases from about 1 mm to about 5 cm in width. According to various embodiments, the plurality of electroluminescent nanomaterials can include a plurality of carbon nanotubes. In other embodiments, the plurality of electroluminescent nanomaterials can include at least one carbon nanotube sheet.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising."

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electrophotographic photoreceptor comprising:

a conductive layer comprising a plurality of electroluminescent nanomaterials, wherein the plurality of electroluminescent nanomaterials comprises a plurality of carbon nanotubes;

a first contact electrically connected to a first edge of the conductive layer and an electrical ground;

a second contact electrically connected to a second edge of the conductive layer and D.C. power supply; and a photosensitive layer disposed over the conductive layer, wherein the photosensitive layer comprises a charge generation material and a charge transport material.

2. The electrophotographic photoreceptor according to claim 1, wherein the plurality of carbon nanotubes are disposed as at least one carbon nanotube sheet.

3. The electrophotographic photoreceptor according to claim 1, wherein the second contact comprises a strip of semi-conductive material.

4. The electrophotographic photoreceptor according to claim 3, wherein the second contact has a sheet of resistance of about $10^4$ to about $10^6$ ohm/sq.

5. The electrophotographic photoreceptor according to claim 1, wherein the second contact comprises a plurality of segmented staggered contact arrays.

6. The electrophotographic photoreceptor according to claim 5, wherein the second contact and the first contact can be at least one of stainless steel roller, metal or carbon particle filled roller, gold coated base metal, and a metal or carbon filled resin brush.

7. The electrophotographic photoreceptor according to claim 1, wherein the D.C. power supply is configured to supply a lateral voltage bias at the second contact to generate a localized electroluminescence across the conductive layer and deliver an erase illumination from within the electrophotographic photoreceptor.

8. The electrophotographic photoreceptor according to claim 1, wherein the conductive layer provide an erase illumination from about 1 nm to about 5 cm in width.

9. An image forming apparatus comprising:

an electrophotographic photoreceptor, wherein the electrophotographic photoreceptor comprises a conductive layer, and wherein the conductive layer comprises a plurality of electroluminescent nanomaterials, the electroluminescent nanomaterials comprising a plurality of carbon nanotubes;

a charging for uniformly charging the electrophotographic photoreceptor;

an imaging station for forming a latent image on the electrophotographic photoreceptor;

a development subsystem for converting the latent image to a visible image on the electrophotographic photoreceptor; and a transfer station for transferring and fixing the visible image onto a media.

10. The image forming apparatus of claim 9, wherein the plurality of carbon nanotubes are disposed as at least one carbon nanotube sheet.

11. The image forming apparatus of claim 9, further comprising a first contact electrically connected to a first edge of the conductive layer and an electrical ground, and a second contact electrically connected to a second edge of the conductive layer and a D.C. power supply.

12. The image forming apparatus of claim 11, wherein the second contact comprises a strip of semi-conductive material.

13. The image forming apparatus of claim 12, wherein the second contact has a sheet resistance of about $10^4$ to about $10^6$ ohm/sq.

14. The image forming apparatus of claim 11, wherein the second contact comprises a plurality of segmented staggered contact arrays.

15. The image forming apparatus of claim 14, wherein the second contact and the first contact can be at least one of stainless steel roller, metal or carbon particle filled roller, gold coated base metal, and a metal or carbon filled resin brush.

16. The image forming apparatus of claim 11, wherein the D.C. power supply is configured to supply a lateral voltage bias at the second contact to generate a localized electroluminescence across the conductive layer and deliver an erase illumination from within the electrophotographic receptor.

17. The image forming apparatus of claim 7, wherein the conductive layer can provide erase illumination from about 1 mm to about 5 cm in width.

18. A method of forming an image, the method comprising:

providing an electrophotographic photoreceptor, wherein the electrophotographic photoreceptor comprises a conductive layer, and wherein the conductive layer comprises layer comprises a plurality of electroluminescent nanomaterials, wherein the plurality of electroluminescent nanomaterials comprises a plurality of carbon nanotubes;

providing an imaging station for forming a latent image on the electrophotographic photoreceptor;

providing a development subsystem for converting the latent image to a visible image on the electrophotographic photoreceptor;

providing a transfer station for transferring an fixing the visible image onto a media; and applying a bias voltage laterally across the conductive layer to make the conductive layer glow laterally and deliver erase illumination from within the electrophotographic photoreceptor.

19. The method of claim 18, wherein applying the bias voltage across the conductive layer provide erase illumination from about 1 nm to about 5 cm in width.

* * * * *